United States Patent [19]

Sarton et al.

[11] Patent Number: 4,649,658

[45] Date of Patent: Mar. 17, 1987

[54] CABLE MARKER DEVICE

[75] Inventors: François Sarton, Totes; Jean-Pierre Barriuso, Buchy, both of France

[73] Assignee: Legrand, Limoges, France

[21] Appl. No.: 585,376

[22] Filed: Mar. 2, 1984

[30] Foreign Application Priority Data

Mar. 4, 1983 [FR] France ..... 83 03575

[51] Int. Cl.[4] ..... G09F 3/00

[52] U.S. Cl. ..... 40/316; 40/23 R; 40/11 R; 40/317

[58] Field of Search ..... 40/23, 316, 11, 317

[56] References Cited

U.S. PATENT DOCUMENTS

| | | | |
|---|---|---|---|
| 3,419,472 | 1/1970 | Walldorf | 40/316 |
| 3,534,777 | 10/1970 | Loof | 40/316 |
| 4,268,986 | 5/1981 | Piana | 40/316 |

FOREIGN PATENT DOCUMENTS

| | | | |
|---|---|---|---|
| 768853 | 10/1967 | Canada | 40/316 |
| 655749 | 1/1938 | Fed. Rep. of Germany | 40/316 |
| 755095 | 11/1951 | Fed. Rep. of Germany . | |
| 973473 | 3/1960 | Fed. Rep. of Germany . | |
| 1103422 | 3/1961 | Fed. Rep. of Germany . | |
| 1102841 | 3/1961 | Fed. Rep. of Germany . | |
| 2614700 | 4/1976 | Fed. Rep. of Germany | 40/316 |
| 1245026 | 9/1959 | France | 40/316 |
| 364824 | 10/1962 | Switzerland . | |
| 924609 | 4/1963 | United Kingdom . | |

*Primary Examiner*—Gene Mancene
*Assistant Examiner*—Wenceslao J. Contreras
*Attorney, Agent, or Firm*—Charles E. Brown; Charles A. Brown

[57] ABSTRACT

A cable marker device comprises two elastically deformable arms integral with a plate. On the side of the plate facing the cable is at least one bearing area. Each arm carries an elastically deformable finger extending inwardly and towards the plate. It bears on the cable through this finger, which urges the bearing area(s) towards the cable.

27 Claims, 16 Drawing Figures

FIG. 6
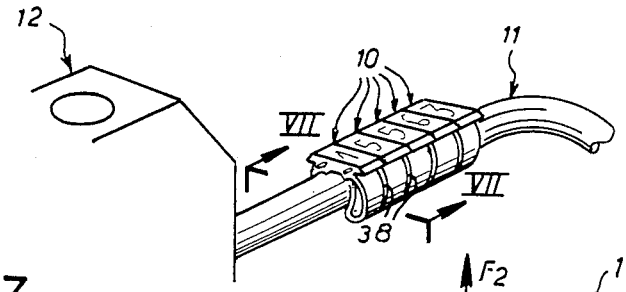
FIG. 7
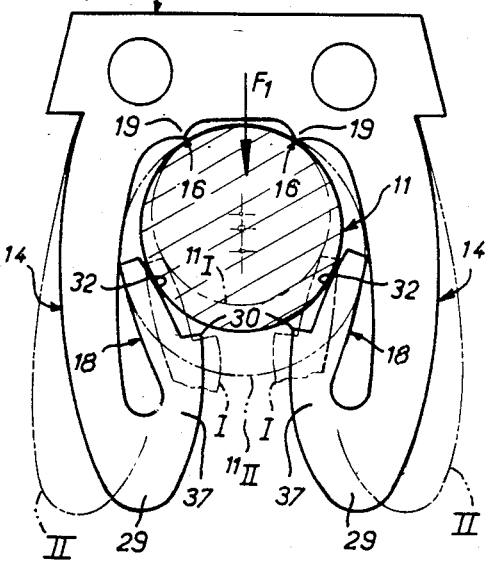
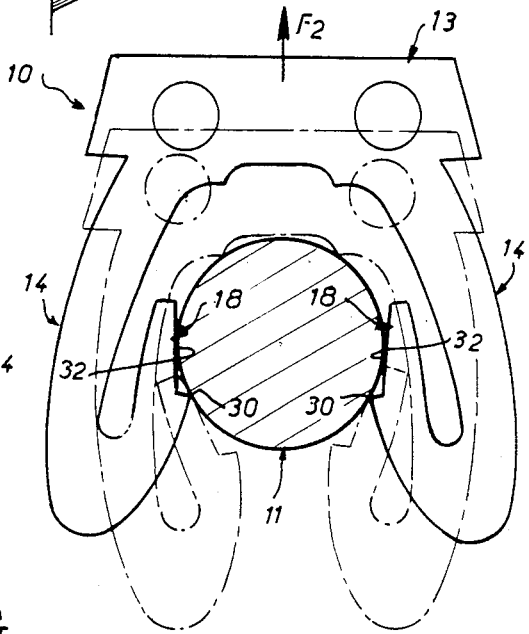
FIG. 8
FIG. 9
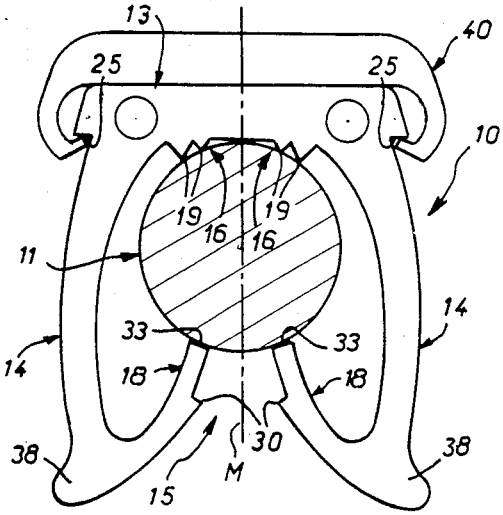
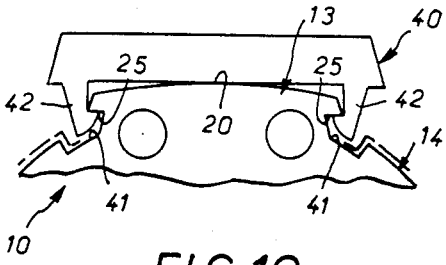
FIG. 10

CABLE MARKER DEVICE

BACKGROUND OF THE INVENTION

1. Field of the Invention

The present invention is generally concerned with the marking of cables or other conductors which may be connected to electrical apparatus, for the purpose of identifying them.

The invention is more particularly directed to the situation in which such marking is carried out by means of at least one marker device which, carrying a marking, more often than not a numeric or alphabetic marking, is adapted to be attached to the cable to be identified, either individually or as part of a group, an appropriately selected plurality of such marker devices being used to compose any required overall marking.

2. Description of the Prior Art

Marker devices of this kind have been known for a considerable time.

The present invention is still more particularly directed to marker devices which comprise two elastically deformable arms integral with a common plate and by means of which they are adapted to form an open loop gripping the cable to be identified.

This applies, for example, to German Pat. Nos. 655 749 and 973 473 and to at least some of the embodiments in Swiss Pat. No. 364 824.

An advantage of these marker devices is that they can be fitted from the side, at any point on the cable to be identified, by means of a simple snap-action engagement on the latter, by virtue of the gap left between the arms and the ability of the latter to deform elastically.

In practice, there is a two-fold problem in producing such marker devices.

The first is concerned with the benefit of being able to fit the same marker device, with well-defined initial dimensional characteristics to cables of different diameters.

The second is concerned with the benefit to be obtained by ensuring that, once fitted to a cable, the marker devices attached to the latter are prevented from rotating on it to a sufficient extent so as to always remain appropriately oriented in the direction enabling the marking on them to be read, whilst also being capable of being rotated on the cable to adjust their position on the latter.

In the aforementioned German Pat. No. 655 749 it is proposed to provide each arm with a finger directed inwardly and towards the plate and through which the arm is adapted to bear on the cable to be identified.

Although a marker device of this type can adapt to cables of different diameters, by virtue of the additional capacity for elastic deformation due to the fingers thus associated with its arms, its transverse retention on a cable is in practice inadequate.

The reason for this is that such retention is due essentially only to the fingers on the arms, without the participation of the plate which is common to the latter.

Taken overall, a marker device of this kind can thus give elastically relative to the cable it is gripping, in particular in line with its plate, which is not aligned with any well-defined reference position.

In German Pat. No. 973 473, and this applies also to Swiss Pat. No. 364 824, the plate common to the two arms of the marker device in question participates in retaining the latter on a cable.

However, the arms intervene directly and thus with a necessarily limited capacity for elastic deformation, and therefore marker devices of this kind are in reality adapted only to cables on a particular diameter.

A general object of the present invention is a cable marker device offering the advantageous combination of an extended capacity for adapting to cables of different diameters with proper retention on such cables.

SUMMARY OF THE INVENTION

The present invention consists in a cable marker device comprising a plate, two elastically deformable arms integral with said plate and forming an open loop by means of which said marker device is adapted to grip a cable, at least one bearing area on that side of said plate adapted to face said cable, and a respective elastically deformable finger on each of said arms, extending inwardly of said open loop and towards said plate and adapted to bear on said cable so as to urge said bearing area towards said cable.

The fingers on the arms advantageously increase the capacity for elastic deformation, providing for the adaptation of the marker device in accordance with the invention to cables of different diameters, within a considerably expanded range of diameters.

In one embodiment, two bearing areas are employed and each is at least in part formed by the internal surface of the plate, so that the latter itself participates in the retention of the device on the cable and so that the device is positively located relative to the latter, at a defined distance, with no possibility of elastic play.

As an alternative, these bearing areas may be carried by elastically deformable tangs, the latter extending parallel to the plate, for example.

They may comprise at least one retaining edge.

Be this as it may, they are efficient in ensuring proper retention of the device on a cable, all the more so in that, being on the internal surface of the plate, it is certain that at least one of them will bear on the cable by virtue of the force exerted by the fingers on the arms, as a result of the latter bearing on the cable.

It is conceded that there are devices, and this applies, for example, to that which is the subject of German patent application No. 1 103 422, in which each arm has a projecting finger cooperating with at least one bearing area in the vicinity of the plate in gripping a cable.

However, a finger of this kind can only be operative through its end, flying buttress fashion, and, being also of relatively small length, it is of only moderate elasticity, just sufficient for it to retract temporarily on fitting to a cable.

In a case of this kind the capacity for adaptation to cables of different diameters is limited and the ability to remain in position on the cable is doubtful in the case of a cable of relatively large diameter.

For preference, each arm of the marker device in accordance with the invention has at its free end a thickened extension and the finger associated with the arm is joined to the thus thickened end of the latter by a section of reduced thickness which is offset inwardly, in the direction towards the other arm, and upwardly, in the direction towards the plate, relative to said extension.

Thus although the arm and the finger retain their capacity for elastic deformation, that of the latter is advantageously channeled in a controlled manner, being dissociated from that of the arm, and to some extent resembling the pivoting of an articulated tab, favouring correct operation of the device.

In the marker device in accordance with the invention, the finger associated with an arm preferably comprises at least one notch on its outside surface, that is to say that of its surfaces facing away from the corresponding arm.

This notch has an asymmetrical profile with one flank of low inclination towards the outside, relative to the open loop formed by the arms, and another flank of steep inclination towards the inside. It does not in any way impede the fitting of the marker device in accordance with the invention to a cable.

However, and with advantage, it contributes to its retention on the cable in the event that it is subject to a force tending to pull it off the cable.

By biting into the insulating jacket of the cable, it vigorously opposes any such pulling off.

Finally, the marker device in accordance with the invention is preferably molded rather than extruded, which gives greater control over its dimensional characteristics and thus its functioning and which further permits it to be provided with advantageous complementary arrangements, such as a cantilever type projection of the plate parallel to its axis, for example.

Other objects and advantages will appear from the following description of examples of the invention, when considered in connection with the accompanying drawings, and the novel features will be particularly pointed out in the appended claims.

BRIEF DESCRIPTION OF THE DRAWINGS

FIG. 6 is a perspective view illustrating the use of the marker device in accordance with the invention on a cable to be identified.

FIG. 7 is a view to a larger scale of the thus equipped cable in transverse cross-section on the line VII—VII in FIG. 6.

FIG. 8 is a view analogous to that of FIG. 7 and illustrating the resistance of the marker device in accordance with the invention to being pulled off the cable to which it is fitted.

FIG. 9 is a view analogous to that of FIG. 7 and showing an alternative embodiment of the marker device in accordance with the invention.

FIG. 10 corresponds to part of FIG. 9 and relates to a further embodiment of the invention.

DESCRIPTION OF THE PREFERRED EMBODIMENTS

Figure 1:
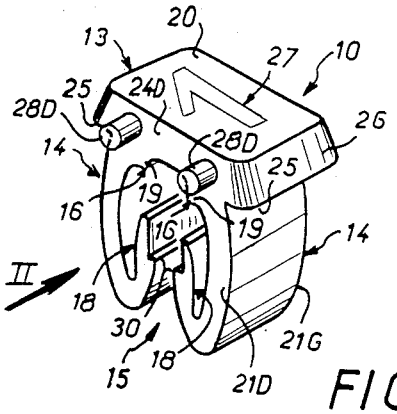
FIG. 1 is a view in perspective of a marker device in accordance with the invention.

As illustrated by FIG. 6, the marker device 10 in accordance with the invention is designed to be fitted to a cable 11 in order to identify it, either singly or, as shown here, in groups, the cable 11 constituting, for example, one of the electrical conductors associated with an electrical apparatus 12.

In practice, and as will emerge hereinafter, the marker device 10 in accordance with the invention is a modular marker device adapted to be combined, where necessary, with other similar marker devices so as to make up, as required, a marker for identifying the cable 11 concerned.

By this as it may, and as is more clearly seen in FIGS. 1 to 5, in which it is represented in isolation, the marker device 10 in accordance with the invention comprises, in a manner known per se, a plate 13 and integral therewith two elastically deformable arms 14 by means of which, as will be described in detail hereinafter, it is adapted to form an open loop clasping the cable 11, the arms 14 defining between them a gap 15 opposite the plate 13 adapted to permit the device to be fitted transversely to the cable 11.

In accordance with the invention, there is at least one bearing area 16 on the internal surface of the plate 13 and each of the arms 14 has, directed inwardly and towards the plate 13, an elastically deformable finger 18 by means of which, as will emerge hereinafter, it is adapted to bear on the cable 11 to which it is to be fitted so as to urge the bearing area 16 towards the cable.

In practice, in the embodiments shown in FIGS. 1 to 8, two bearing areas are provided, one on each side of the median axial plane M of the device, and each comprises a projecting retaining edge 19.

In this context, the median axial plane of the marker device 10 in accordance with the invention is the plane which, passing through the axis of the cable 11 to which it is to be fitted, constitutes overall a plane of symmetry for the marker device 10.

Figure 2:
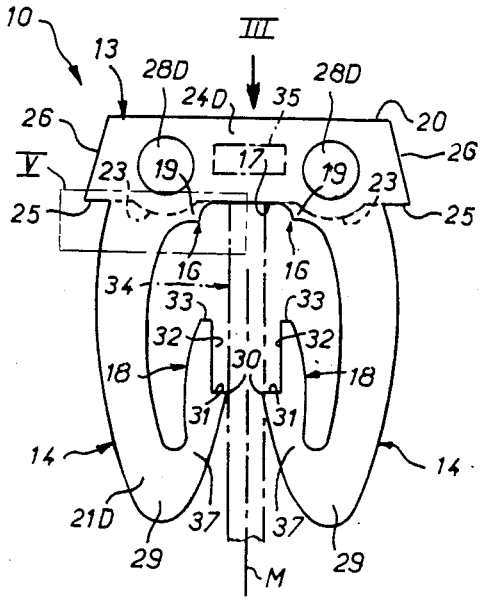
FIG. 2 is a view in elevation of this marker device, to a larger scale and as seen in the direction of the arrow II in FIG. 1.
Figure 3:
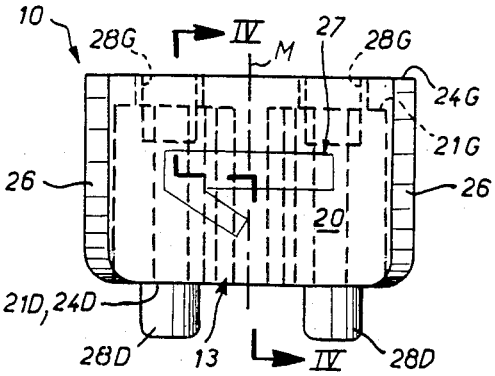
FIG. 3 is a plan view of it as seen in the direction of the arrow III in FIG. 2.

This median axial plane M is indicated on FIGS. 2 and 3.

It is substantially perpendicular to the plate 13.

In practice, the arms 14, the associated fingers 18 and the bearing areas 16 with their retaining edge 19 extend longitudinally, parallel to the median axial plane M of the device, in the fashion of portions of a cylinder, each retaining edge 19 extending over the full length of the associated bearing area 16.

In other words, these arms 14, these fingers 18, these bearing areas 16 and the retaining edges 19 of the latter are delimited by generatrices parallel to this median axial plane M.

Also, these generatrices are all of the same length, with the result that, in line with the arms 14, the fingers 18 and the bearing areas 16, the marker device 10 in accordance with the invention is delimited in the transverse direction by two parallel surfaces 21D, 21G.

On the other hand, the generatrices of the plate 13 are longer than those of the arms 14, the fingers 18 and the bearing areas 16.

In other words, in the direction parallel to the axis of the device, the plate 13 projects cantilever fashion relative to the arms 14, on at least one side of the latter.

In the embodiment shown in FIGS. 1 to 8, it projects cantilever fashion on one side only of the arms 14, being the same side as the transverse surface 21G of the latter, for example and as shown here.

Figure 4:
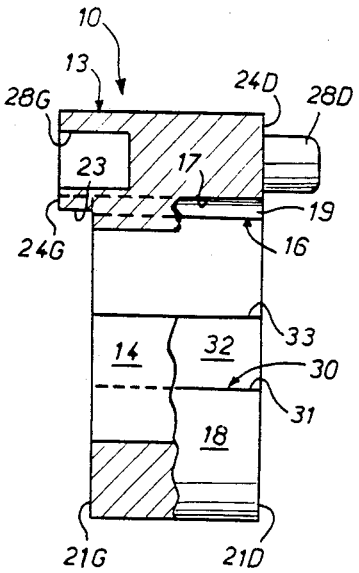
FIG. 4 is a view of it in longitudinal cross-section on the broken line IV—IV in FIG. 3.

Because of this there is a shoulder 23 between this transverse surface 21G and the corresponding transverse edge 24G of the plate 14 (see FIG. 4).

On the other hand, the opposite transverse edge 24D of the latter is aligned with the corresponding transverse surface 21D.

Also, externally, the plate 13 projects laterally beyond the arms 14, on each side of the median axial plane M of the device, perpendicularly to this plane.

There is thus, in the lateral direction, between the plate 13 and each of the arms 14, a shoulder 25 which, in the embodiment shown in FIGS. 1 to 8, is substantially aligned with the internal surface 17 of the plate.

In the embodiment shown in FIGS. 1 to 8, the corresponding lateral edges 26 of the plate 13 are obliquely disposed relative to the median axial plane M, converging towards one another in the direction away from the cable 11.

As a result, the plate 13 has the general shape of the bottom part of a prism, with an upper surface 20 and a lower surface formed, on the outside, by the shoulders 25.

Seen in plan, each side of the plate has a generally rectangular contour, with two opposed edges in common, this contour being rounded at the corners corresponding to the transverse edge 24D, as is more clearly shown in FIG. 3.

In practice, in the embodiment shown in FIGS. 1 to 8, the upper surface 20 of the plate 13 is flat and perpendicular to the medium axial plane M of the device, and the same applies to its shoulders 25, the latter extending parallel to the upper surface 20.

In the embodiment shown in FIGS. 1 to 8, the plate 13 itself carries a mark 27, disposed directly on its upper surface 20. This mark may comprise, for example and as shown here, a numeric mark applied by printing, for example.

It may also be a mark in upstanding relief or in hollow relief, or a mark produced by bonding on a preprinted film, for example.

Complementary engagement devices are provided parallel to the median axial plane M of the device, comprising female devices on one transverse side of the device and male devices on the opposite transverse side thereof.

In the embodiment shown in FIGS. 1 to 8, these engagement devices consist, on the one hand, of two cylindrical blind holes 28G, of circular contour in this embodiment, formed in the transverse edge 24G of the plate 13, on the projecting side of the latter, disposed one on each side of the median axial plane M, and, on the other hand, two pegs 28D complementary to the holes 28G and disposed in correspondence with the latter parallel to the median axial plane M, projecting from the opposite transverse edge 24D of the plate 13.

In practice, the holes 28G which thus constitute the female engagement devices employed and the corresponding pegs 28D are disposed in line with the root portions of the arms 14.

Thus the local increase in thickness (as compared with the basic plate 13) due to the arms 14 is used to accommodate the holes 28G, with the benefit that, other things being equal, these holes 28G may be of maximum transverse cross-section.

A corresponding increase in thickness is obtained in the projecting part of the plate 13 by conferring a rounded profile on the shoulder 23 which the plate 13 forms relative to the transverse surface 21G of the arms 14, the fingers 18 and the bearing areas 16 with retaining edge 19, in line with and concentric to the holes 28G.

In the embodiment shown in FIGS. 1 to 8, the retaining edges 19 of the bearing areas 16 are formed directly on the internal surface 17 of the plate 13, in the vicinity of the root portion of the arms 14, where the latter are contiguous with the plate 13.

Thus, by locally increasing the thickness of the device, the retaining edges 19 advantageously reinforce the device in the part thereof which will be particularly highly stressed when it is fitted to a cable 11, namely those corresponding to the intersection of the arms 14 with the plate 13. The inevitable weakening caused by the holes 28G is thus at least partially compensated for.

Figure 5:
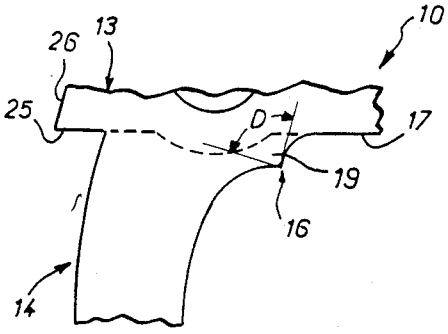
FIG. 5 shows to a larger scale the detail of FIG. 2 marked by the box V thereon.

In the embodiment shown in FIGS. 1 to 8, and as is most clearly seen in FIG. 5, each retaining edge 19 is defined by the intersection of two part-cylindrical surfaces subtending at the point of intersection an angle D of approximately 90°, these part-cylindrical surfaces having the same radius or, as shown here, different radii, in this case that on the same side as the arm 14 having the larger radius.

The arms 14 are generally curved, their internal and external surfaces being substantially parallel to one another and generally rounded, with their concave side directed inwardly.

The associated fingers 18 are also merged with the arms 14 in a rounded manner.

Preferably, and as shown, for the purposes of this merging each arm 14 has, at its free end, an extension 29 of greater thickness and the associated finger 18 is linked to the thus thickened end of the arm 14 by a section 37 of reduced thickness, forming a hinge, which thus constitutes what might be thought of as its origin and which is offset simultaneously inwards, in the direction towards the other arm 14, and upwards, in the direction towards the plate 13, relative to the extension 29.

The thickened extension 29 which the arms 14 thus feature is also exploited to confer a curved convergent contour with large radii of curvature on the insertion gap 15 formed between the arms 14.

The internal surface of each finger 18, that is to say the surface facing the corresponding arm 14, is also preferably of generally rounded form, with its concave side facing inwardly, like the internal and external surfaces of the arm 14.

Also for preference and as shown, each of the fingers 18 comprises at least one notch 30 on its external surface, that is to say on its surface facing away from the corresponding arm 14.

For the unstressed configuration of the device, and as shown in FIG. 2, the respective notches 30 in each of the fingers 18, which correspond the one with the other, are spaced from one another.

They define the minimum width of the insertion gap 15 of the device.

Having a convergent contour, the width of the latter decreases from its inlet end, being the end furthest from the plate 13, to its other end, being that defined by the notches 30 in the fingers 18.

Thus each of these notches 30 is defined on the one hand by the corresponding flank of the insertion gap 15, the inclination of which is relatively moderate, and on the other hand by a flank 31 which, set back relative to the aforementioned flank, has a relatively steeper inclination.

In the embodiment shown, the flank 31 is, in the unstressed configuration of the device, substantially perpendicular to the median axial plane M of the latter.

Moreover, in this unstressed configuration, the end 32 of the internal surface of each of the fingers 18, that is to say the part of this internal surface which extends beyond the steep flank 31 of the corresponding notch 30 in the direction towards the plate 13, is substantially parallel to the median axial plane M of the device.

Finally, the terminal edge 33 of each of the fingers 18 is preferably plane, as shown, and extends substantially perpendicular to the median axial plane M of the device in the unstressed configuration of the latter.

For purposes of presentation to the cable, the marker device 10 in accordance with the invention may be engaged upon a supporting rail 34, as schematically represented in chain-dotted line in FIG. 2.

It may be so engaged in isolation or in line with other marker devices 10 of the same type.

To this end, the distance which, in the unstressed configuration, separates the notches 30 of the fingers 18 from one another is the same for all of them.

The marker device 10 in accordance with the invention may be fitted to a cable 11 by hand.

It may also be fitted using a tool.

This may be, for example, a tool comprising two grooves lined up with and facing one another, into which the lateral ends of the plate 13 of a marker device 10, between the upper surface 20 of the latter and its shoulders 25, are inserted.

In this case, the fitting of the marker device 10 in accordance with the invention to a tool of this kind is preferably effected from the side of the transverse edge 24D of the plate 13 carrying the engagement pegs 28D, the rounded corners of the plate 13 facilitating this.

As an alternative, the tool used, if any, may merely consist of a simple rod.

In this case, for the purposes of fitting the market device 10 in accordance with the invention to a tool of this kind, there may be provided an appropriate opening in the thickness of the plate 13, of rectangular contour, for example, this opening extending parallel to the median axial plane M of the device, symmetrically on either side of the latter, as schematically represented in chain-dotted outline (35) in FIG. 2.

A marker device 10 in accordance with the invention may be fitted to a cable 11 in isolation if a single marking 27 in sufficient to identify the cable 11.

As shown, and as already indicated, a plurality of devices may instead be fitted to the cable when its identification requires a more complex marking, made up from these individual markings 27.

The various marker devices 10 then employed for this purpose are preferably fastened together in pairs by engagement of their pegs 28D in the respective holes 28G.

The consecutive marker devices 10 then mate with one another through the contact between the transverse edges 24D, 24G of their respective plates 13.

As there are no rounded areas at any point over the full height of these edges 24D, 24G, the corresponding surface areas in bearing engagement are advantageously maximized.

Similarly, as the inlets to the holes 28G are not rounded off, the engagement of the pegs 28D in these holes 28G is advantageously maximized, in spite of the rounded off ends of the pegs 28D intended to facilitate their insertion into the holes 28G.

As will have been understood, in addition to the fastening function which the pegs 28D and the holes 28G thus provide, they also implement a polarizing function, by virtue of which the marking required to identify the cable 11 is constituted from individual markings 27 which are all disposed the same way up.

The fitting of the or each marker device 10 to the cable 11 is facilitated by the convergent contour of the insertion gap 15 which a marker device 10 of this kind features for this purpose.

This naturally requires the fingers 18 and the arms 14 to move apart elastically.

On completion of this insertion, beyond the notches 30 in the fingers 18, the device closes elastically around the cable 11 (FIG. 7).

The fingers 18 then bear on the cable 11 through the end 32 of their internal surface whereas, more often than not and as shown here, the notches 30 remain spaced from the cable 11.

Bearing in this way on the cable 11, the fingers 18 urge the entire marker device 10 of which they form part, and thus the bearing area 16 with retaining edges of the latter, elastically towards the cable 11, in the direction of the arrow F1 in FIG. 7.

These edges then bite into the insulating jacket of the cable 11, which brings about the required positioning.

By virtue of the small number of retaining edges 19 employed in practice, the pressure exerted on the cable 11 by each of the retaining edges 19 is maximized, with the result that it penetrates into the insulating jacket of the cable 11 to a relatively great extent, sufficient in any event in this embodiment to normally oppose any rotation of the marker device 10 relative to the cable 11.

In addition to their polarizing and fastening functions already mentioned, the pegs 28D and holes 28G of a marker device 10 of this kind have another function, when a plurality of marker devices 10 grouped together are fitted to a cable 11, which is to increase the resistance to any such rotation around the cable 11 by resisting any rotation of these marker devices 10 relative to one another.

When several marker devices 10 are used grouped together, a further function of the pegs 28D and holes 28G is to enhance the retention of the combination on the cable 11, through the stiffening of the marker devices 10 relative to one another that they bring about.

By virtue of the shoulder 23 due to the projecting plate 13, gaps 38 (FIG. 6) remain between the respective arms 14 of the marker devices 10 employed, the marker devices 10 being in contact with one another only via the transverse edges 24D, 24G of their plates 13; the marker devices 10 are thus better adapted to following any curvature of the cable 11, the pegs 28D and holes 28G coupling them together naturally being capable giving slightly to permit this, in spite of their stiffening effect.

As will be understood, the shoulder 23 also constitutes a projection on the marker device 10 which facilitates handling of the device.

Finally, for a given width of the plates 13, required for proper visibility of the marking 27 carried by the latter, it offers the advantage of reducing the quantity of material required per marker device 10.

As will also be understood, the flatness of the plate 13 of the marker device 10 in accordance with the invention facilitates the reading of the marking 27 which it carries.

It also facilitates the printing thereof.

Because of the elasticity of its arms 14 and that of the fingers 18 associated with the latter, the marker device 10 in accordance with the invention may be used on cables 11 of different diameters.

This facility is illustrated in FIG. 7 in which a cable 11 of average diameter is shown in full line and there are also schematically represented a cable $11_I$ of smaller diameter and a cable $11_{II}$ of larger diameter.

Partially represented in FIG. 7, in chaindotted line, are the configuration I of the end of the fingers 18 corresponding to the cable $11_I$ and the configuration II of the arms 14 corresponding to the cable $11_{II}$.

The smaller the diameter of the cable 11, the nearer the portion of the fingers 18 bearing on the cable is to the terminal edge 33 thereof.

Conversely, the larger the diameter of the cable 11 the nearer the portion of the fingers 18 which bears on the cable is to the notches 30.

In the limit, the notch 30 in a finger 18 may contribute to the bearing engagement of the finger 18 on the cable 11.

Be this as it may, in the case of a cable of relatively large diameter, when the fingers 18 move closer to the associated arms 14, by elastic deformation and pivoting about their section 37 of reduced thickness, the rounded shape of their external surface facilitates such movement, as its concave side is oriented in the same direction as the internal surface of the arm 14.

As will be noted, in spite of the elastic deformation to which they are also subjected, the arms 14 retain the same general configuration at their ends by virtue of the local stiffening due to their thicker extensions 29.

If, as represented schematically by the arrow F2 in FIG. 8, the marker device 10 in accordance with the invention is subject to a force tending to pull it off the cable 11 which it is gripping, it moves from its initial position shown in chain-dotted line in FIG. 8 to a position in which, as shown in full line in the figure, the notch 30 in each of its fingers 18 comes into contact with and bites into the insulating jacket of the cable 11, so effectively resisting any such pull-off force.

In the embodiment shown in FIG. 9, each bearing area 16 comprises a group of retaining edges 19 and each of these groups comprises at least two retaining edges 19.

In order to adapt to the curvature of the cable 11 to be gripped, the retaining edges 19 of the same group are preferably of different height, as indicated in the figure.

Also, in the embodiment shown, at their point of intersection the arms 14 and the fingers 18 are extended outwardly, not by a simple thickened extension as previously, but by a spur 38 which increases the length of the corresponding insertion gap 15 and is thus able to facilitate the fitting of the device to a cable 11.

Finally, in this embodiment, the shoulders 25 formed at the outside edges of the lower surface of the plate 13 are used for the snap-action engagement on the marker device 10 in accordance with the invention of a cover 40 adapted to protect the marking 27 carried by the plate 13, the cover 40 being to this end in a translucent material or having in it an opening adapted to expose the marking in question.

As an alternative, the cover 40 may itself carry a marking, particularly in the case where the plate 13 to which it is attached is unmarked.

As will be understood, the oblique lateral edges 26 of the plate 13 facilitate the snap-action engagement on the latter of a cover 40 of this kind.

Moreover, in the embodiment shown in FIG. 9, it is the terminal edge 33 of each of the fingers 18 which bears on the cable 11.

It need hardly be said that the same could equally well apply in the previous embodiment.

In the embodiment shown in FIG. 10, a cover 40 is also provided but the root portion of the arms 14 is appropriately thickened so that the snap-action engagement of the cover 40 is with grooves 41 formed between the arms 14 and the plate 13, formed in part by the shoulders 25 of the plate 13.

As shown schematically in chain-dotted line in FIG. 10, on elastic deformation of the arms 14, these grooves 41 advantageously and at least in part close on the tabs 42 by means of which the cover 40 is retained on the marker device 10, which locks the cover 40 to the latter.

As will be noted, in the embodiment shown, the upper surface 20 of the plate 13 is slightly curved, whereas the corresponding cover 40 is flat.

Figure 11:
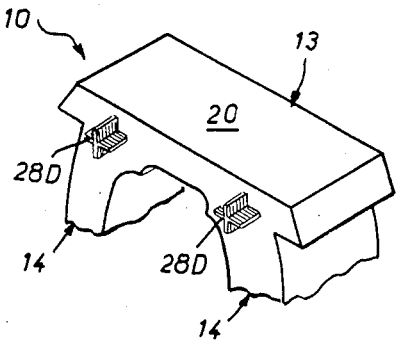
FIGS. 11 and 12 are partial views in a cross-section analogous to that of FIG. 1 and relating to respective yet further embodiments of the marker device in accordance with the invention.

In the embodiment shown in FIG. 11, the engagement devices carried by the plate 13 have a cruciform transverse contour, rather than a circular contour as previously, as is visible for the corresponding pegs 28D in FIG. 11.

However, as previously, these devices can only be engaged with one another by means of a relative displacement parallel to the axis of the device, that is to say parallel to the axis of the open loop which the device forms.

Figure 12:
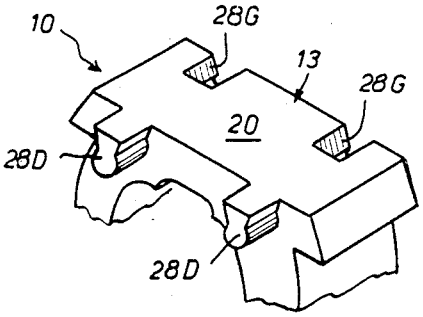

In the embodiment shown in FIG. 12, this engagement is also possible perpendicularly to this axis, the holes 28G opening outwardly into the upper surface of the plate 13.

In this case they have a keyhole-shaped transverse cross-section, for example and as shown, the associated pegs 28D naturally having a complementary profile.

More generally, the transverse profile of the holes 28G must then have a throat of less width than their outlet on to the upper surface of the plate 13.

Figure 13:
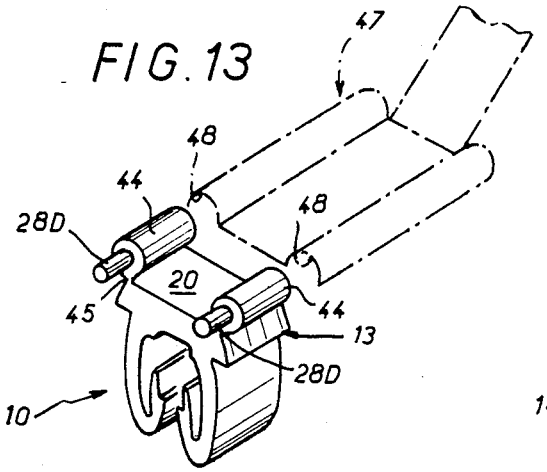
FIG. 13 is a perspective view analogous to that of FIG. 1 and concerns a still further embodiment.

In the embodiment shown in FIG. 13, the complementary male and female engagement devices with which a marker device 10 in accordance with the invention is equiped are carried by distinct engagement members 44 which are integral with the plate 13.

The engagement members 44 are preferably integral with the plate 13 in a readily detachable manner.

In the embodiment shown, they are cylinders linked to the plate 13 along each of the lateral edges of the upper surface 20 of the latter by a tearable strip 45.

Engagement members of this kind may with advantage themselves constitute handling members.

As shown schematically in chain-dotted line in FIG. 13, the tool 47 used to fit the marker device 10 in accordance with the invention to a cable may comprise two parallel grooves 48, concave downwards, in which the engagement members 44 of the marker device 10 may be inserted.

After the marker device 10 in accordance with the invention is fitted to a cable, these engagement members 44 may be removed, if required, by tearing the corresponding strips 45.

Alternatively, they may be retained.

Be this as it may, the complementary male and female engagement devices which they carry at their ends may have any of the profiles described hereinabove when seen in transverse cross-section; in the embodiment shown only the corresponding pegs 28D are visible, and these have a circular profile in transverse cross-section.

Figure 14:
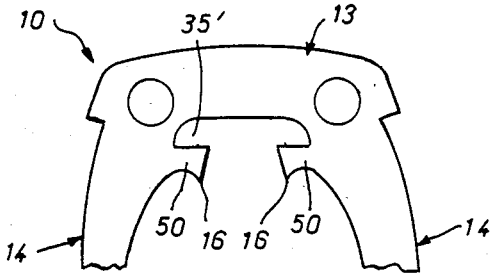
FIG. 14 is a partial view in elevation analogous to that of FIG. 2 and concerns a yet further embodiment.

In the embodiment shown in FIG. 14 the bearing areas 16 which a marker device 10 in accordance with the invention comprises are each carried by a respective elastically deformable tang 50.

In practice, an elastically deformable tang 50 of this kind is formed from the corresponding arm 14 and extends substantially parallel to the plate 13.

The elastically deformable tangs 50 which the marker device 10 in accordance with the invention thus features then define with the plate 13 a space 35′ adapted to enable them to be fitted to a fitting tool having a shank of complementary cross-section.

In the embodiment shown, each bearing area 16 thus formed on an elastically deformable tang 50 comprises a retaining edge 19, as previously.

Figure 15:
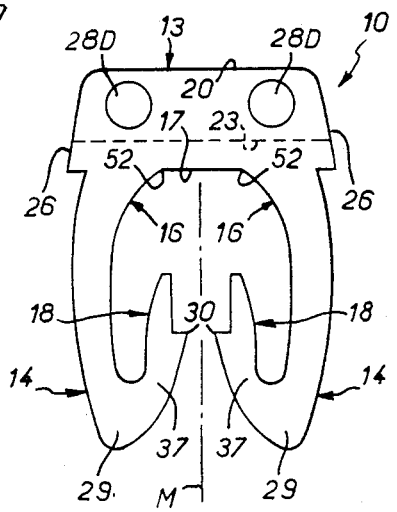
FIG. 15 is a view in elevation analogous to that of FIG. 2 and concerns a still further embodiment of the marker device in accordance with the invention.

In the embodiment shown in FIG. 15, which is adapted to the situation in which there is a requirement for controlled rotation of the marker device 10 on the cable to which it is fitted, for adjusting its position on the latter, for example, or to facilitate reading thereof, whilst eliminating the possibility of unwanted rotation of the marker device on the cable, the bearing areas 16 have no retaining edges.

They are thus generally smooth cylindrical surfaces which, continuous with the internal surfaces of the arms 14, link the latter to the internal surface 17 of the plate 13, along an edge 52, for example and as shown.

In all other respects, this embodiment is generally similar to that described in detail with reference to FIGS. 1 to 8 having, in particular, a thickened extension 29 at the end of the arms 14 and fingers 18 linked to these arms 14 by a section 37 of reduced thickness. Also, it operates and is used in the same way.

Apart from the absence of retaining edges, it also differs from the previous embodiment in the following minor respects: there is a rounded section linking the lateral edges 26 of the plate 13 and the upper surface 20 of the latter and, the plate 13 being of sufficient height, the shoulder 23 formed on its lower surface by the projection of the plate 13 is plane and perpendicular to the median axial plane M of the device.

In the foregoing description, it is assumed that the fingers 18 associated with the arms 14 are not only integral with the latter but also of exactly the same material as the arms 14.

In an alternative arrangement (FIG. 16) they may be fabricated from a different material, better suited to providing the required elasticity.

Figure 16:
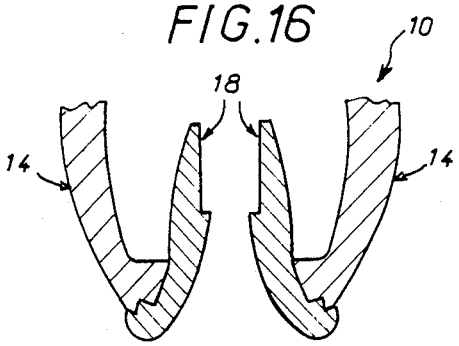
FIG. 16 is a partial view in transverse cross-section section of a yet further embodiment of the marker device in accordance with the invention.

In all cases, the marker device 10 in accordance with the invention is advantageously fabricated by molding, this molding implying the use of a single synthetic material for the embodiments of FIGS. 1 to 15 only whereas, for the embodiment shown in FIG. 16, two different synthetic materials are employed simultaneously, using processes familiar to those skilled in this art.

It will be understood that various changes in the details, materials and arrangements of parts, which have been herein described and illustrated in order to explain the nature of the invention, may be made by those skilled in the art within the principle and scope of the invention as expressed in the appended claims.

There is claimed:

1. In a cable marker device of the type including a plate, two individual elastically outwardly deformable arms integral with said plate and forming an open loop by means of which said marker device is adapted to grip a cable, an improvement comprising at least one bearing area adjacent an inner side of said plate adapted to face a cable, and a respective elastically deformable finger extending from an end of the respective arm remote from said plate and substantially into said open loop and towards said plate, and said fingers being separate and apart from one another and defining means for bearing on a cable and flexing with respect to said arms and away from each other so as to urge said bearing area towards a cable.

2. A cable marker device according to claim 1, having a median axial plane extending between said arms and through said plate and comprising two of said bearing areas on said inner side of said plate adapted to face a cable, there being one bearing area on each side of said median axial plane.

3. A cable marker device according to claim 1, wherein each of said arms has an extension of increased thickness at its free end.

4. A cable marker device according to claim 1, wherein each of said fingers has adjacent said end of the respective one of said arms a portion of reduced thickness through the intermediary of which it is linked to the respective one of said arms.

5. A cable marker device according to claim 4, wherein said portion of reduced thickness is offset towards the other of said arms and towards said plate.

6. A cable marker device according to claim 1, wherein a resultant gap between said ends of said arms remote from the plate has a curved, inwardly convergent profile with large radii of curvature.

7. A cable marker device according to claim 1, further comprising at least one notch on that surface of each of said fingers facing toward the other of said fingers to define the minimum width of an insertion gap between said fingers for a cable.

8. A cable marker device according to claim 7, wherein said notch has an asymmetrical profile such that, when said cable marker device is unstressed, one flank of said profile is substantially perpendicular to said median axial plane.

9. A cable marker device according to claim 1, wherein that surface of each of said fingers facing that of said arms which carries it is rounded with the concave side of its curve directed towards the interior of said open loop.

10. A cable marker device according to claim 1, wherein said plate projects beyond said arms in the lateral direction, on each side of said median axial plane, and has lateral end surfaces disposed obliquely relative to one another on an outer side of said plate which is adapted to face away from a cable.

11. A cable marker device comprising a plate, two individual elastically outwardly deformable arms integral with said plate and forming an open loop by means of which said marker device is adapted to grip a cable, at least one bearing area on that side of said plate adapted to face a cable, and a respective elastically deformable finger on each of said arms, extending inwardly of said open loop and towards said plate and adapted to bear on a cable so as to urge said bearing area towards a cable, and wherein said plate projects axially beyond said arms on at least one end of said plate, in the direction perpendicular to said open loop.

12. A cable marker device according to claim 11, further comprising, on respective opposite surfaces of said plate perpendicular to a median axial plane extending between said arms and through said plate, complementary and cooperating male and female engagement devices extending in the direction perpendicular to said open loop, said female engagement devices being on the end on which said plate projects beyond said arms.

13. A cable marker device according to claim 12, wherein said female engagement devices are disposed in line with root portions of said arms.

14. A cable marker device according to claim 1, further comprising distinct engagement members joined integral with said plate and, carried by said engagement members, complementary and cooperating male and female engagement devices extending in the direction perpendicular to said open loop.

15. A cable marker device according to claim 14, wherein said engagement members are adapted to be readily detached from said plate.

16. A cable marker device according to claim 14, wherein said engagement members also constitute grip members.

17. A cable marker device according to claim 1, wherein said at least one bearing area incorporates at least one retaining edge.

18. A cable marker device according to claim 17, wherein said at least one bearing area incorporates a group of retaining edges comprising at least two retaining edges.

19. A cable marker device according to claim 18, wherein at least two of said retaining edges in each of said groups are of different heights.

20. A cable marker device according to claim 17, wherein said at least one retaining edge is disposed in the vicinity of root portions of said arms, where said arms are contiguous with said plate.

21. A cable marker device according to claim 17, comprising a plurality of retaining edges and wherein at least one of said retaining edges is directly formed on that surface of said plate adapted to face said cable.

22. A cable marker device according to claim 1, further comprising at least one elastically deformable tang on which is formed said at least one bearing area.

23. A cable marker device according to claim 22, wherein said tang projects from one of said arms.

24. A cable marker device according to claim 23, wherein said tank extends parallel to said plate.

25. A cable marker device according to claim 1, comprising a plurality of discrete ones of said bearing areas and wherein at least one of said bearing areas is generally smooth.

26. A cable marker device according to claim 25, wherein said at least one generally smooth bearing area has one edge contiguous with that surface of said plate adapted to face said cable.

27. A cable marker device of the type including a plate, two elastically deformable arms integral with said plate and forming an open loop by means of which said marker device is adapted to grip a cable, wherein the improvement comprises at least one bearing area adjacent an inner side of said plate adapted to face a cable, and a respective elastically deformable finger extending from the end of the respective arm remote from said plate substantially into said open loop, said fingers having free end edges forming means for elastically bearing against a cable and urging said at least one bearing area towards a cable, whereby a cable will be clamped exclusively between said free end edges of said fingers and said at least one bearing area.

* * * * *